US006702611B1

(12) United States Patent
Miyazaki et al.

(10) Patent No.: US 6,702,611 B1
(45) Date of Patent: Mar. 9, 2004

(54) SHIELDED CONNECTOR

(75) Inventors: Sho Miyazaki, Nagoya (JP); Tetsuo Ichioka, Nagoya (JP)

(73) Assignees: Autonetworks Technologies, Ltd., Nagoya (JP); Sumitomo Wiring Systems, Inc., Mie (JP); Sumitomo Electric Industries, Ltd., Osaka (JP)

( * ) Notice: Subject to any disclaimer, the term of this patent is extended or adjusted under 35 U.S.C. 154(b) by 83 days.

(21) Appl. No.: 09/643,731

(22) Filed: Aug. 23, 2000

(30) Foreign Application Priority Data

Aug. 23, 1999 (JP) ..... 11-235984

(51) Int. Cl.[7] ..... H01R 13/73
(52) U.S. Cl. ..... 439/559; 439/564
(58) Field of Search ..... 439/610, 609, 439/608, 607, 559, 843, 844, 839, 564

(56) References Cited

U.S. PATENT DOCUMENTS 4,187,481 A * 2/1980 Boutros ..... 333/182
5,823,824 A 10/1998 Mitamura et al. ..... 439/585
5,911,599 A * 6/1999 Masuda ..... 439/610
5,947,766 A * 9/1999 Tsuji et al. ..... 439/559
6,062,919 A * 5/2000 Trafton ..... 439/843

FOREIGN PATENT DOCUMENTS

| | | |
|---|---|---|
| DE | 198 22 015 A1 | 11/1998 |
| EP | 0 584 937 A | 3/1994 |
| JP | 7-245153 | 9/1995 |
| JP | 8-78098 | 3/1996 |
| JP | 08 064306 A | 3/1996 |

* cited by examiner

*Primary Examiner*—Alexander Gilman
(74) *Attorney, Agent, or Firm*—Oliff & Berridge PLC

(57) ABSTRACT

The male connector 10 serves in itself as a shielding shell by forming the cylindrical hood portion 14 with a conductive aluminium sleeve 31, and leakage of noises from the slit of the shielding shell as in the conventional arrangement may be avoided since the hood portion 54 encloses completely around the male terminal fitting 36, thereby improving the shielding property.

14 Claims, 8 Drawing Sheets

SHIELDED CONNECTOR

BACKGROUND OF THE INVENTION

1. Field of the Invention

The present invention relates to a shielded connector for mounting on a shielded wall of electrical equipment or to a terminal to be mounted to a shielded cable.

2. Description of the Related Art

FIGS. 9 and 10 illustrate an example of a shielded connector to be mounted to a terminal of a shielded cable, which was disclosed in Japanese Patent Laid-Open No. 7-245153. The connector housing 109 included in the shielded connecter 100 has a double structure comprising an inner housing 101 and an outer housing 102 formed in the shape of a cylinder of a synthetic resin being superimposed one on another, a connecting wall 103 partly connecting between peripheral surfaces of the inner housing 101 and the outer housing 102, a terminal fitting 104 received in the inner housing 101, and a shielding shell 105 formed in the cylindrical shape of a metal sheet inserted between the inner housing 101 and the outer housing 102. The shielding shell 105 serves to enclose and to shield the periphery of the terminal fitting 104, and a part of the outer housing 102 constitutes a cylindrical hood portion 107 opening toward the other corresponding part, to which the other corresponding connector 120 is fitted and locked by a locking arm 108 provided on the hood portion 107. The terminal fitting 104 is provided with a shielded cable D1 crimped thereon, and the shielding layer and the shielding shell 105 are conductively connected with respect to each other.

FIGS. 11 and 12 illustrate an example of a shielded connector to be mounted on the shielded wall of electrical equipment, which is presented in Japanese Patent Laid-Open No. 8-78098. The shielded connector 110 also comprises an inner housing 111 and the outer housing 112 constructed of a synthetic resin partly connected via a connecting wall (not shown), and a metallic shielding shell 115 inserted therebetween to enclose the terminal fitting 114 received in the inner housing 111, wherein a part of the outer housing 112 constitutes a hood portion 116, and the other corresponding connector (not shown) is engaged with the locking hole 120 formed on the hood portion 116. The connector 110 is provided at the rear end of the outer housing 112 with a flange 117, which is screwed to the shielded wall 119 with the packing mounted on the flange 117 crushed by the shielded wall 119. The part of the flange 117 within the packing 118 is provided with a plurality of presser strips 115B extending sideward from the rear end portion of the shielding shell 115, the presser strips 115B being pressed against the shielded wall 119 to conductively connect the shielding shell 115 and the shielded wall 119.

The conventional shielded connectors 100 and 110 have a problem in that noises tend to leak through a slit (See 115A, FIG. 11) formed on the shielded shell corresponding to the connecting wall for connecting the inner housing and the outer housing, thus resulting in degradation of shielding property.

Since the shielded connector to be mounted on the shielded wall 119 of electrical equipment includes presser strips 115B on the flange 117, the flange 117 has to be significantly large in size correspondingly, thereby requiring a large mounting space on the shielded wall 119.

Since the flange 117 constitutes a part of the connector housing constructed of a synthetic resin, there is apprehension that the flange is deformed by heat and thus the screw that fix the flange 117 to the shielded wall 119 is loosened, thereby degrading the connection and waterproof property between the presser strips 115B and the shielded wall 119.

SUMMARY OF THE INVENTION

Accordingly, with the circumstanced described above in view, it is an object of the invention to provide a shielded connector that has superior shielding property, requires only a small mounting space when being mounted to electrical equipment, and has good resistance to water at the mounting portion.

The shielded connector according to a first aspect of the invention comprises a connector housing for accommodating a terminal fitting, a cylindrical hood portion provided on the connector housing for being fitted to the other corresponding connector, and locking means provided on the hood portion for preventing both of connectors from being detached, wherein the hood portion is constructed by mounting a cylindrically formed conductive member to the connector housing, and a shielding shell is constructed by enclosing the terminal fitting by the conductive member.

In this arrangement, since the cylindrical hood portion is constructed of a conductive material and thus the hood portion itself serves as a shielding shell, the terminal fitting may be enclosed without any clearance by the peripheral wall closed along the entire side surface of the conductive material, so that leaking of noises through the slit formed on the shielding shell may be avoided, thereby improving the shielding property.

A second aspect of the invention is the shielded connector as set forth in connection with the first aspect of the invention characterized in that the shielded wall provided on electrical equipment is formed with a mounting hole for mounting the connector therethrough, and the flange extending sideward from the conductive member is screwed against the shielded wall so that the conductive member and the shielded wall are conductively connected.

In this arrangement, since the flange extending from the conductive member constituting the shielding shell is fixed and conductively connected to the shielded wall, the space used for mounting on electrical equipment may be reduced in comparison with the conventional arrangement wherein the portion conductively connected to the shielded wall and the flange to be used for the purpose of fixing are provided independently.

A third aspect of the invention is the shielded connector as set forth in the first and second aspects of the invention, characterized in that the conductive member is constructed of metal.

In this arrangement, since the conductive member is constructed of metal, the strength and heat resistant property is improved, thereby preventing the deformation of the hood portion engaged with the other corresponding connector and the flange screwed onto the shielded wall. By providing a packing between the flange and the shielded wall, the packing is pressed against the shielded wall stably, thereby improving the waterproof property.

A fourth aspect of the invention is a shielded connector as set forth in any of the first to the third aspects, wherein a contact the middle portion of which is divided into a plurality of bands projecting sideward is fitted on the peripheral surface of the conductive member, and is resiliently in contact with the other corresponding shielding shell provided on the other corresponding connector.

In this arrangement, resilient force of the contact crashed between the conductive material as a shielding shell and the other corresponding shielding shell ensures the conductive connection between these shielding shells.

A fifth aspect of the invention is the shielded connector as set forth in any of the second to the fourth aspects of the invention, wherein the surface of the flange abutting against the shielded wall is formed with an annular groove near the inner edge thereof by pitting it in the direction away from the shielded wall, and the connector housing is provided with a inner flange projecting outward to be interposed between the inner wall of the annular groove and the shielded wall.

In this arrangement, the inner flange projecting outward from the connector housing is interposed between the shielded wall and the flange screwed onto the shielded wall to fix the connector housing onto the shielded wall together with the conductive member.

A sixth aspect of the invention is the shielded connector as set forth in any of the second to the fifth aspects of the invention, wherein the portion of the annular groove outside of the inner flange receives a packing that is interposed between the inner wall of the annular groove and the shielded wall in intimate contact therewith, and the packing is provide with a stopper projecting inwardly therefrom for being interposed between the inner flange and the inner wall of the annular groove.

In this arrangement, the stopper projecting inwardly from the packing is interposed between the inner flange and the inner wall of the annular groove to prevent the packing from being detached from the annular groove of the flange, thereby facilitating the operation to mount the shielded connector to the shielded wall.

DETAILED DESCRIPTION OF THE PRESENT INVENTION

Figure 1:
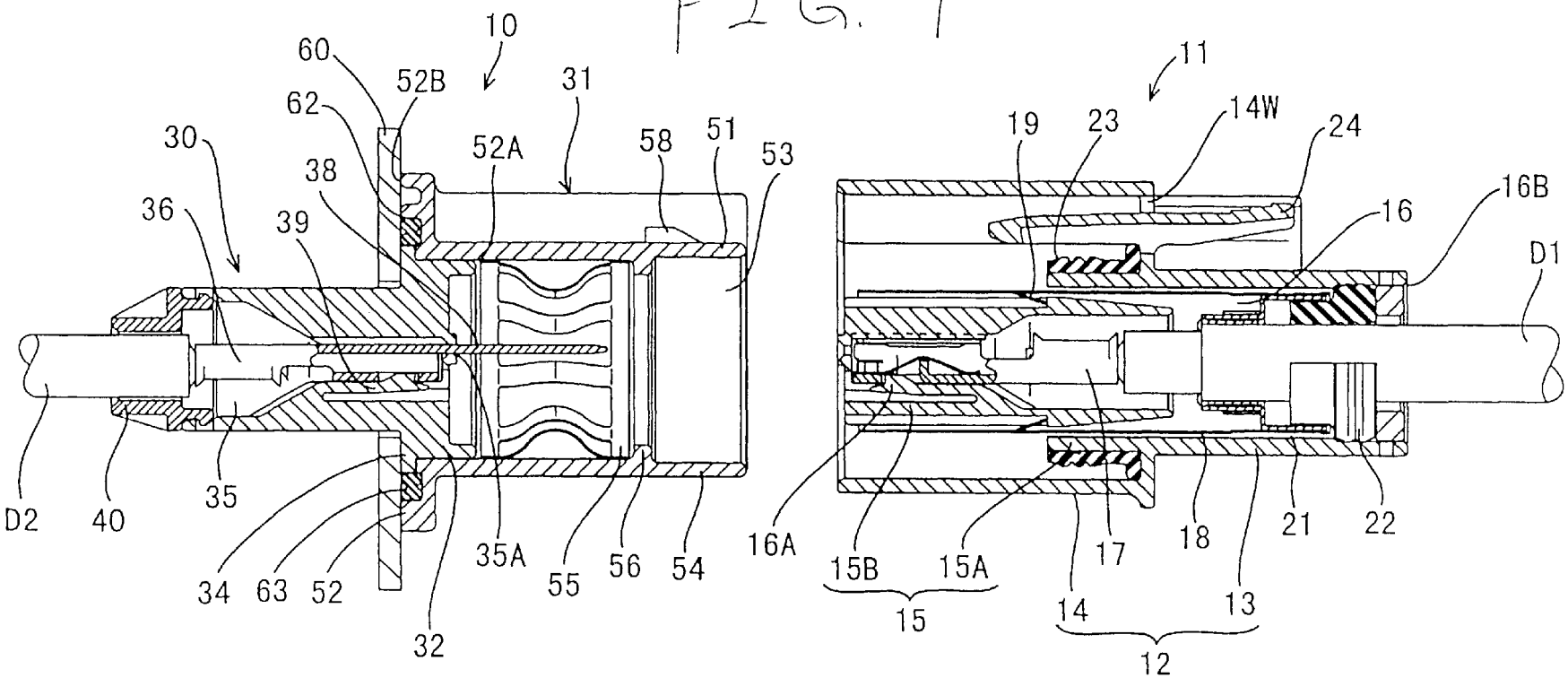
FIG. 1 is a side cross-sectional view showing a male and female shielded connectors according to an embodiment of the present invention.
Figure 2:
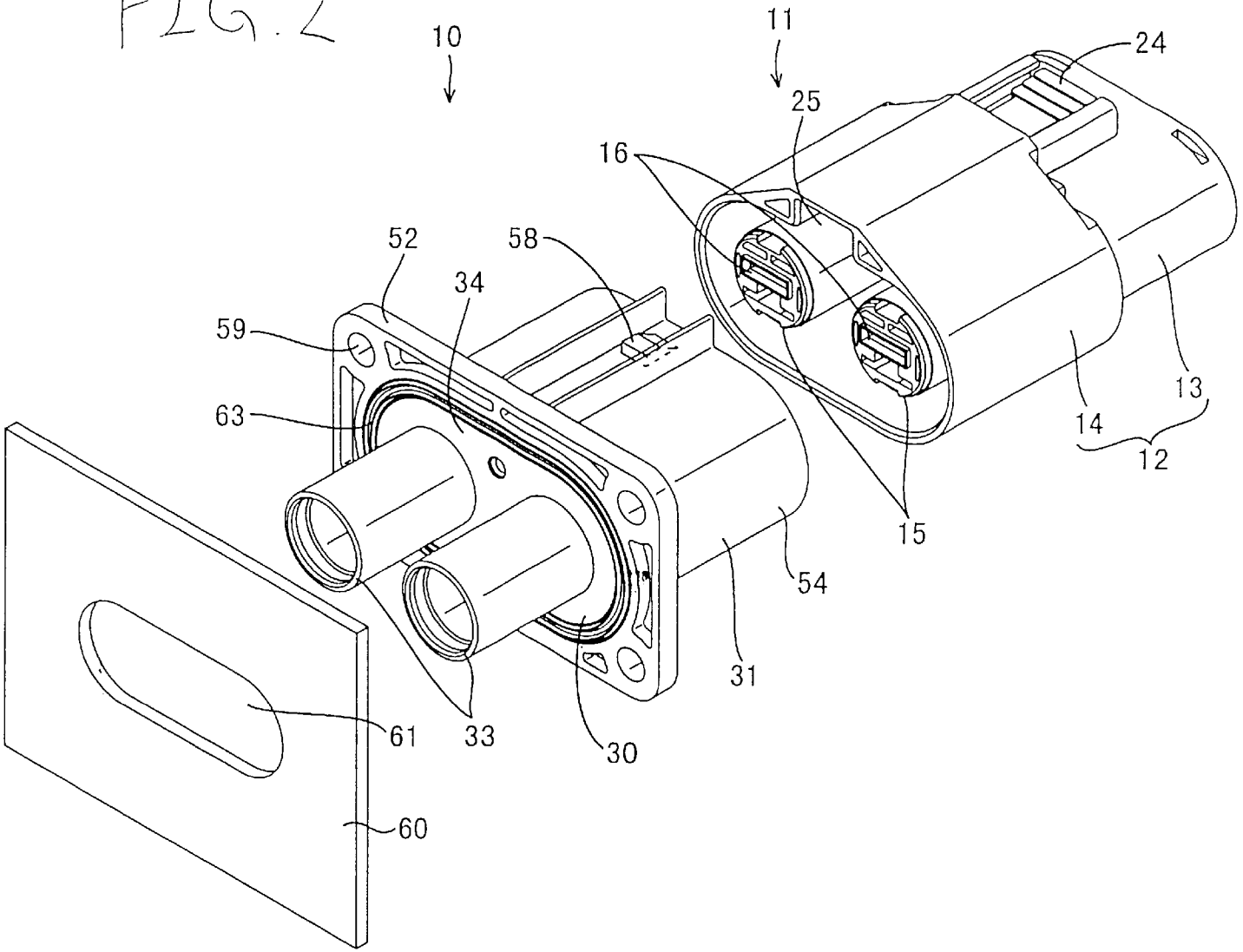
FIG. 2 is a perspective view of the shielded connector shown in FIG. 1.

Referring now to FIG. 1 to FIG. 8, an embodiment of the invention will be described in detail. In this embodiment, the invention is applied to the male shielded connector 10 shown in FIG. 1 on the left (hereinafter referred to as "male connector 10"), which is mounted on the shielded wall 60 provided on electrical equipment and is connected to the female shielded connector 11 shown on the right (hereinafter referred to as "female connector 11"). The description will be made referring to the sides of the respective connectors 11, 12 that face the other corresponding connector as "front".

The female connector 11 will be described first, to which the present invention is not applied. The female connector 11 is fixed on the terminal of the shielded cable D1, and the female connector housing 12 constituting the female connector 11 and being constructed of an insulating resin (hereinafter referred to as "female housing 12") comprises a housing body 13 and a hood portion 14 enclosing the front side of the housing body 13, and a pair of cylindrical portions 15, 15 extending from the front end of the housing body 13 located at the back of the hood portion 14 in parallel. A pair of cavities 16, 16 is formed on each cylindrical portion 15 and the housing body 13, through which female fittings 17 are received respectively and locked by the respective resin rances 16A, as shown in FIG. 1.

Each cylindrical portion 15 has a conventional structure, as shown in FIG. 1, such that the rear end of the small diameter cylindrical portion 15B is received coaxially in the large diameter cylindrical portion 15A projected from the front surface of the housing body, and the respective peripheral surfaces thereof are partly connected via a connecting wall, not shown.

As in the conventional arrangement, the shielded shell 18 having a slit corresponding to the connecting wall is inserted between both of cylindrical portions 15A and 15B and locked with the metallic rance 19 extending from the shielded shell 18 so that they are not detached. The rear end portion of the shielded shell 18 is conductively connected to the shielding layer of the shielded cable D1 crimped to the female terminal fitting 17 via a metallic sleeve 21.

The upper surface of the housing body 13 is provided with a locking arm 13 in the shape of a seesaw as shown in FIG. 1, and the portion of the locking arm 24 extending forward from the fulcrum is received into the hood portion 14 via the notch 14W formed on the proximal end of the hood portion 14 (See FIG. 1)

The rear end opening of the cavity 16 is sealed with the rubber plug 22 fitted into the shielded cable D1, and a rubber ring 23 is fitted on the outer surface of the large diameter cylindrical portion 15A, thereby ensuring watertightness between the fitted portion and the other corresponding connector.

The male connector 10 to which the present invention is applied is as follows. The male connector 10 comprises a male connector housing 30 (hereinafter referred to as "male housing 30") and an aluminium sleeve 31 assembled thereon as shown in FIG. 1.

Figure 3:
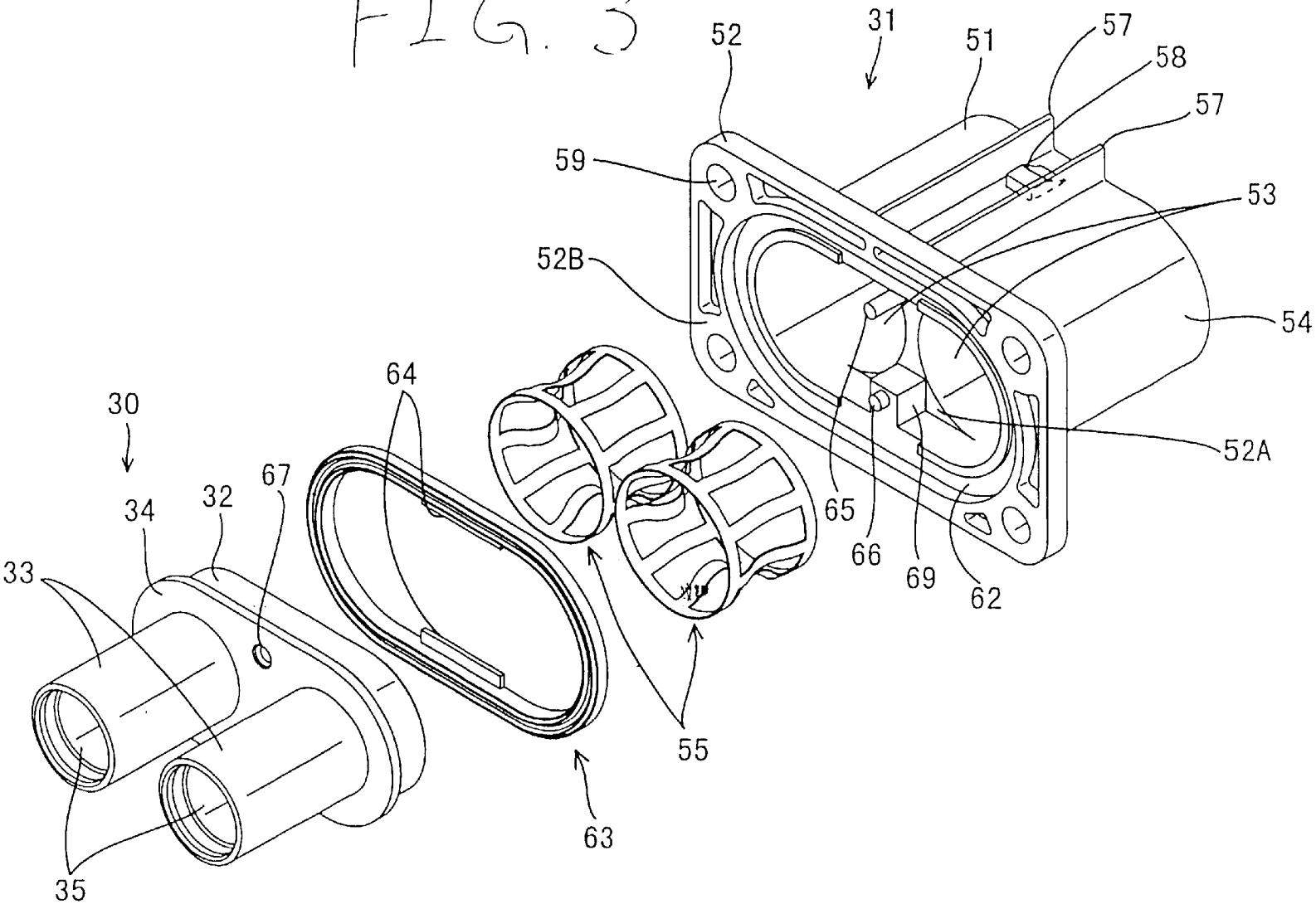
FIG. 3 is an exploded perspective view of the male shielded connector.
Figure 4:
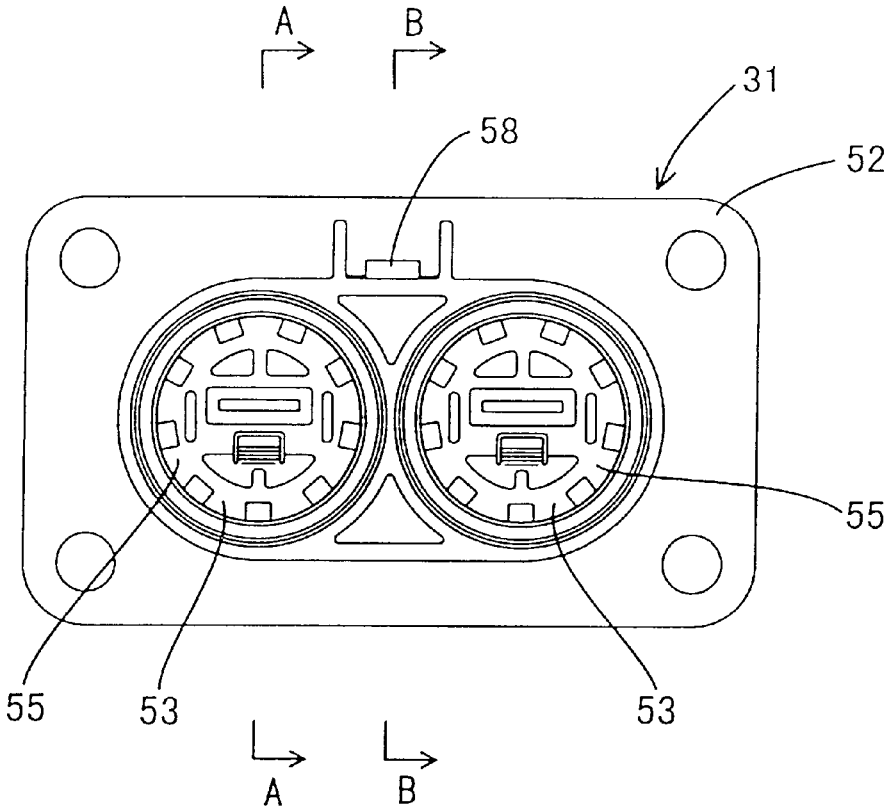
FIG. 4 is a front view of the male shielded connector.
Figure 5:
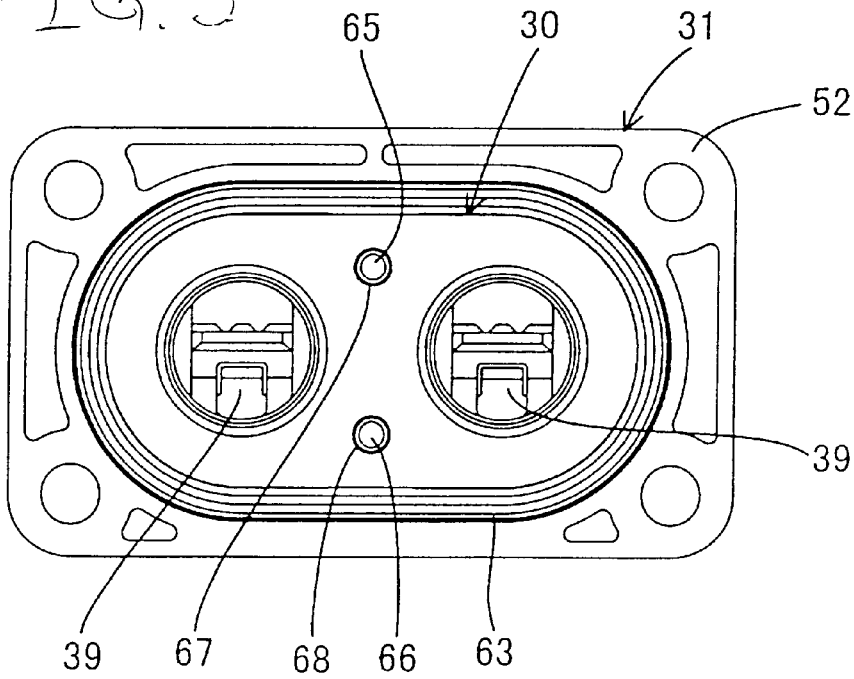
FIG. 5 a back view of the male shielded connector.
Figure 6:
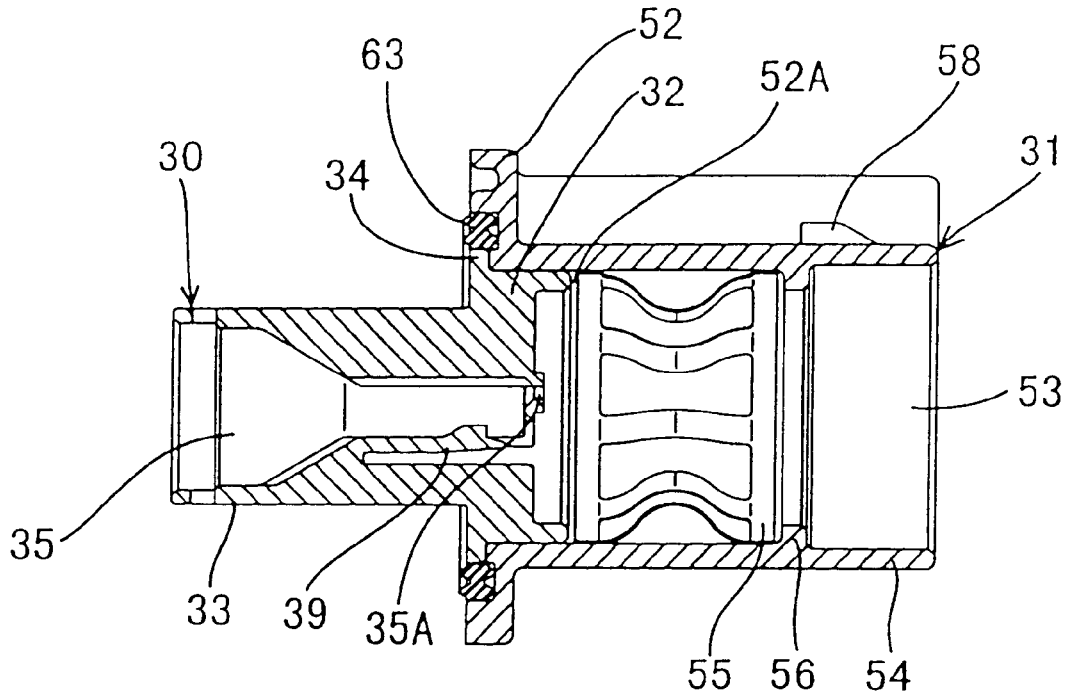
FIG. 6 is a side cross sectional view taken along the line A—A of FIG. 4.

The male housing 30 generally shown in the lower left of the FIG. 3 is constructed of an insulating resin, and comprises a base portion 32 being oval in cross section and flat in the direction of axis, a pair of cylindrical portions 33, 33 extending rearward from the rear end surface of the base portion 32 in parallel, and a resin flange 34 extending sideward from the rear periphery of the base portion 32. As shown in FIG. 1, cavities 35 are formed through the respective cylindrical portions 33 and the base portion, to which the male terminal fitting 36 is received.

The male terminal fitting 36 is locked in the cavity 35 by the resin rance 39 with a tab 38 formed on the front end projected from the front opening 35 of the cavity 35 toward the front of the base portion 32. The cable D2 having no shielding layer is crimped to the male terminal fitting 36, and is supported by the sleeve 40 (See FIG. 1) provided at the opening edge of the rear end of the cavity 35 so that it does not hang over the edge thereof.

The aluminium sleeve 31 generally shown on the upper right of FIG. 3 is an aluminium die-casting having conductivity, and configured as follows. The main body 51 being oval in cross section and extending forward and backward is provided with an aluminium flange 52 of horizontally extending rectangular at the rear end thereof, and the rear end surface of the aluminium flange 52 is formed with a recess 52 pitted axially up to the midway along the main body 51, to which the base portion 32 of the male housing 30 is fitted (See FIG. 1).

The main body 51 is provided with a pair of communicating holes 53, 53 corresponding to the respective cavities 35, 35 in a forward-rearward direction, and one end of which is opening toward the inner face of the recess 52A (See FIG. 3). The tab 38 of the male terminal fitting 36 projects from the front face of the base portion 32 of the male housing 30 into the inside of the communicating hole 53, whereby the peripheral wall of the communicating hole 53 constitutes the hood portion 54 for receiving the other corresponding connector.

The inner peripheral surface of the hood portion 54 is formed with a projecting thread 56 projecting inwardly at the forward position thereof as shown in FIG. 1, and the contact 55 is assembled in the communicating hole 53 in such a manner that it is interposed between the projecting thread 56 and the front end surface of the male housing 30. The contact 55 has a structure such that the middle portion of the cylindrical metallic sheet is divided into a plurality of bands being bent inwardly.

The upper surface of the main body 51 facing upward in FIG. 3 is provided with a locking projection 58 to be engaged with the locking arm 24.

The aluminium flange 52 is, as shown in FIG. 3, formed with four boltholes at four corners therethrough. The bolts (not shown) are passed through the boltholes 95 and screwed to the shielded wall 60 with the aluminium flange 52 abutted against the peripheral edge of the connector mounting hole 61 formed on the shielded wall 60.

Figure 7:
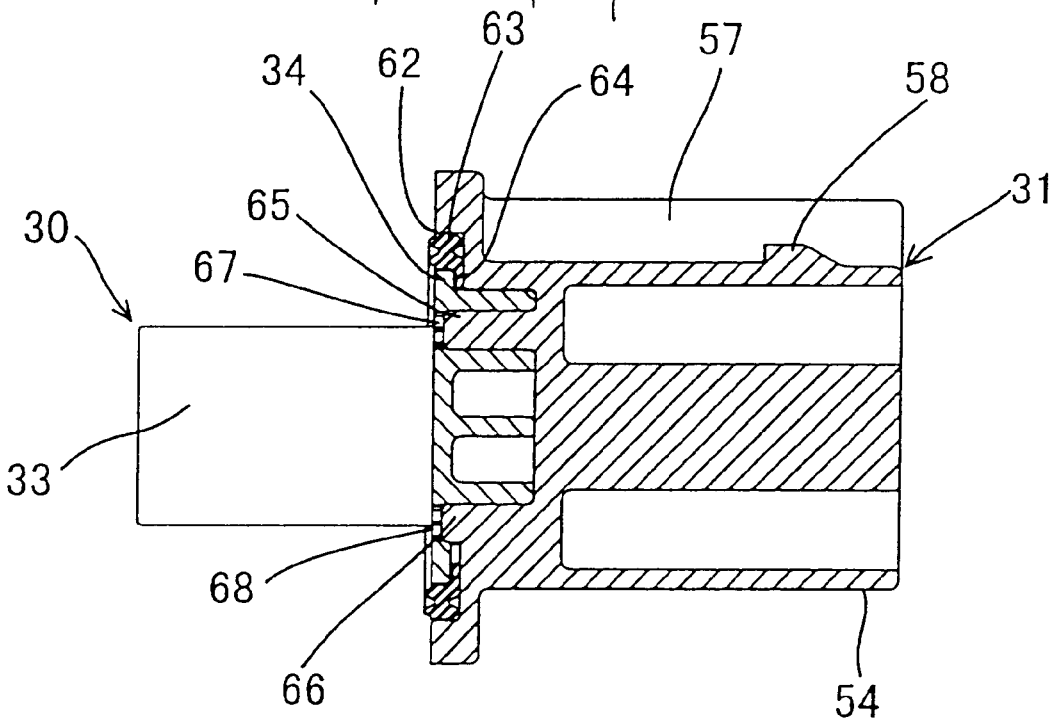
FIG. 7 is a side cross sectional view taken along the line B—B of FIG. 4.

The portion of the surface 52B of the aluminium flange 52 abutting against the shielded wall 60 is formed with an annular groove 62 near the inner edge thereof by pitting it in the direction away from the shielded wall 60, and the resin flange 34 provided on the male housing 30 is abutted against the inner edge portion of the inner wall of the annular groove 62, and the packing 63 is fitted on the resin flange 34. The inner peripheral surface of the packing 63 shown in FIG. 3 is provided with stoppers 64, 64 extending from the upper portion and the lower portion toward each other, and as shown in FIG. 7, these stoppers 64 are interposed between the resin flange 34 and the inner wall of the annular groove 62. Such an arrangement prevents the packing 63 from being detached.

The aluminium sleeve 31 and the male housing 30 are, as shown in FIG. 7, positioned and locked by press fitting a pair of pins 65, 66 projecting rearward from the aluminium sleeve 31 into a pair of press-fitting holes 67 and 68 formed on the male housing 30. More specifically, the respective press-fitting holes 67 and 58 are provided with a plurality of projecting threads axially extending therein, which are crushed by the pins 65 and 66, whereby the pins 65 and 66 are held in the press-fitting holes 67 and 68 respectively. In this arrangement, the male housing and the aluminium sleeve 31 are integrated.

The effect of this embodiment will be now described.

In order to assemble the male connector 10 to the shielded wall 60 of electrical equipment, the rear end portion (cylindrical portion 33) of the male connector 10 is inserted into the connector mounting hole 61 formed on the shielded wall 60 and the aluminium flange 52 is abutted against the peripheral edge portion of the connector mounting hole 61. During this operation, since the packing 63 is not detached because a part (stopper 64) thereof is interposed between the resin flange 34 and the inner wall of the annular groove 62, the mounting operation can be carried out easily.

Then, the bolt is inserted into the bolthole 59 formed on the aluminium flange 52 and screwed into the threaded portion, not shown, formed on the shielded wall 60. Then, the aluminium flange 52 is pressed against the shielded wall 60 so that the outer edge portion of the aluminium flange 52 comes into intimate contact with the shielded wall 60, and the aluminium sleeve 31 as a shielding shell is conductively connected to the shielded wall 60. The aluminium flange 52 here has high strength as distinct from the conventional flange constructed of a synthetic resin, the bolt may be tightened strongly, thereby ensuring the intimate contact between the aluminium flange 52 and the shielded wall 60 to stabilize the conductive connection therebetween.

When the aluminium flange 52 is pressed against the shielded wall 60, the packing 63 is crushed by a prescribed extent so that watertightness between electrical equipment and the male connector 10 is ensured. The resin flange 4 provided on the male housing 30 is interposed between the shielded wall 60 and the aluminium flange 52 so that the male housing 30 is fixed on the shielded wall 60 together with the aluminium sleeve 31.

Figure 8:
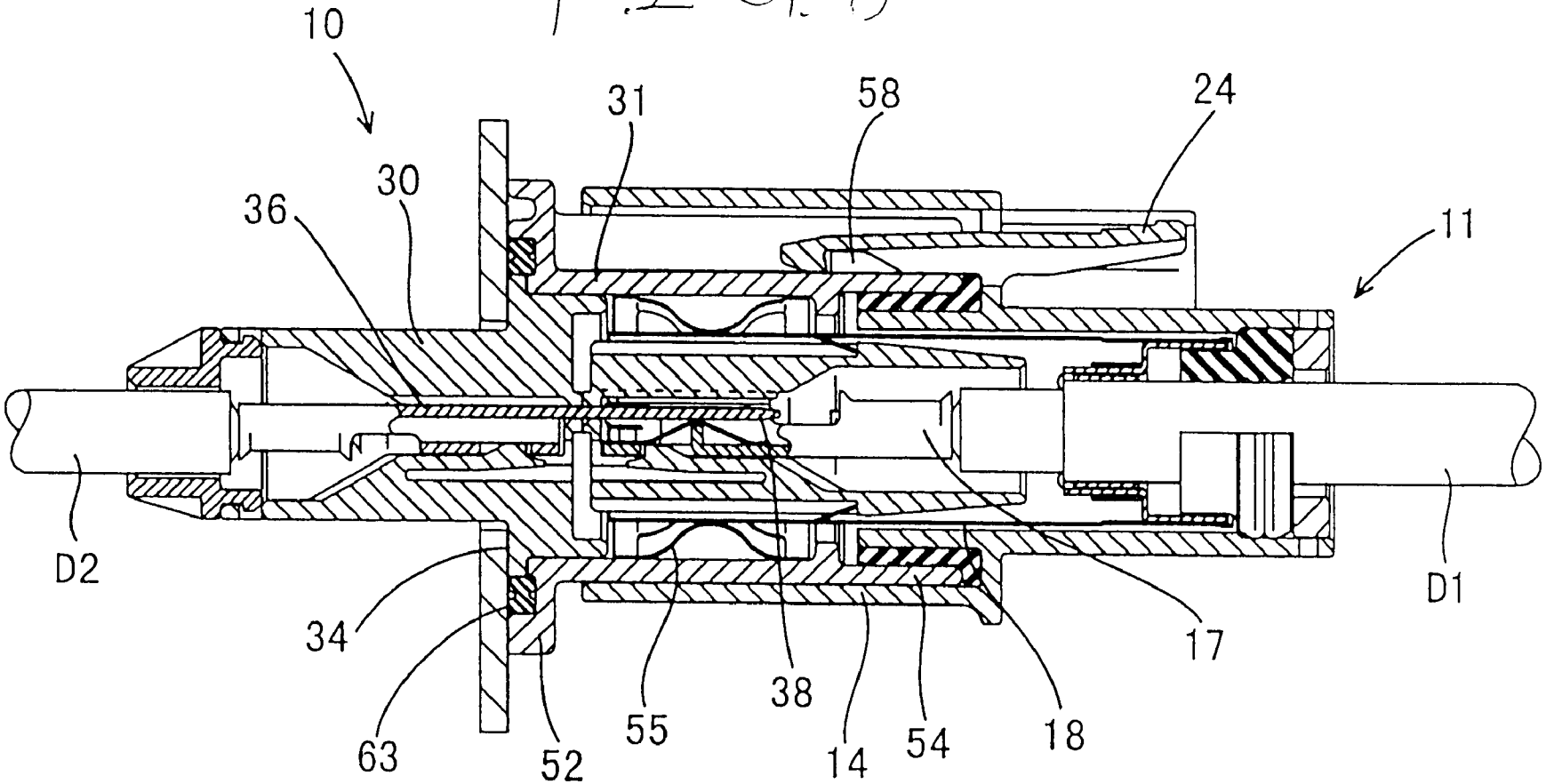
FIG. 8 is a side cross sectional view in the state that the male and female shielded connectors are connected.
Figure 9:
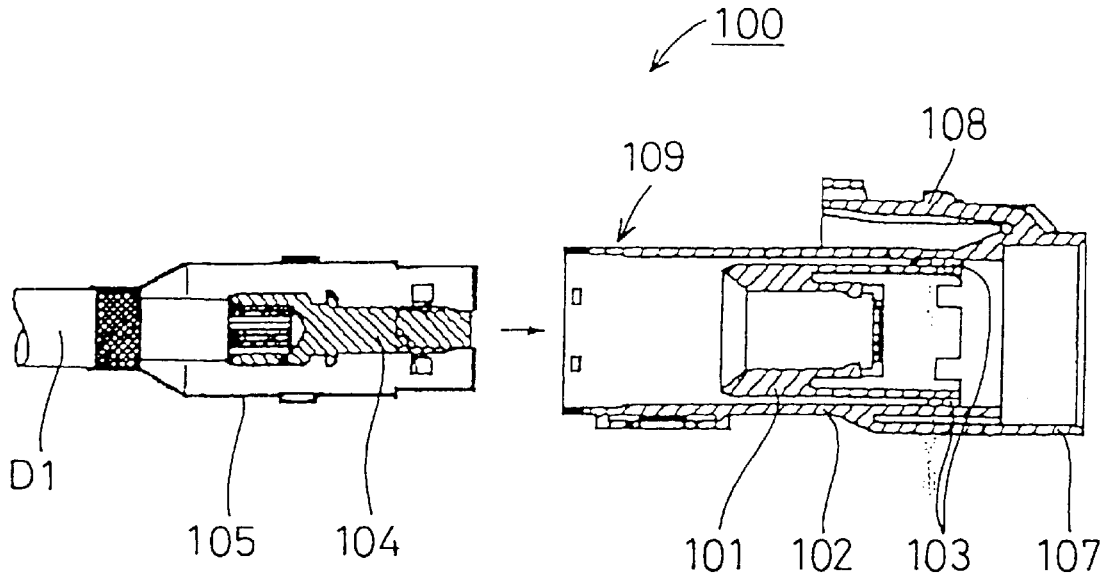
FIG. 9 is an exploded cross sectional view of the shielded connector according to the conventional example 1.
Figure 10:
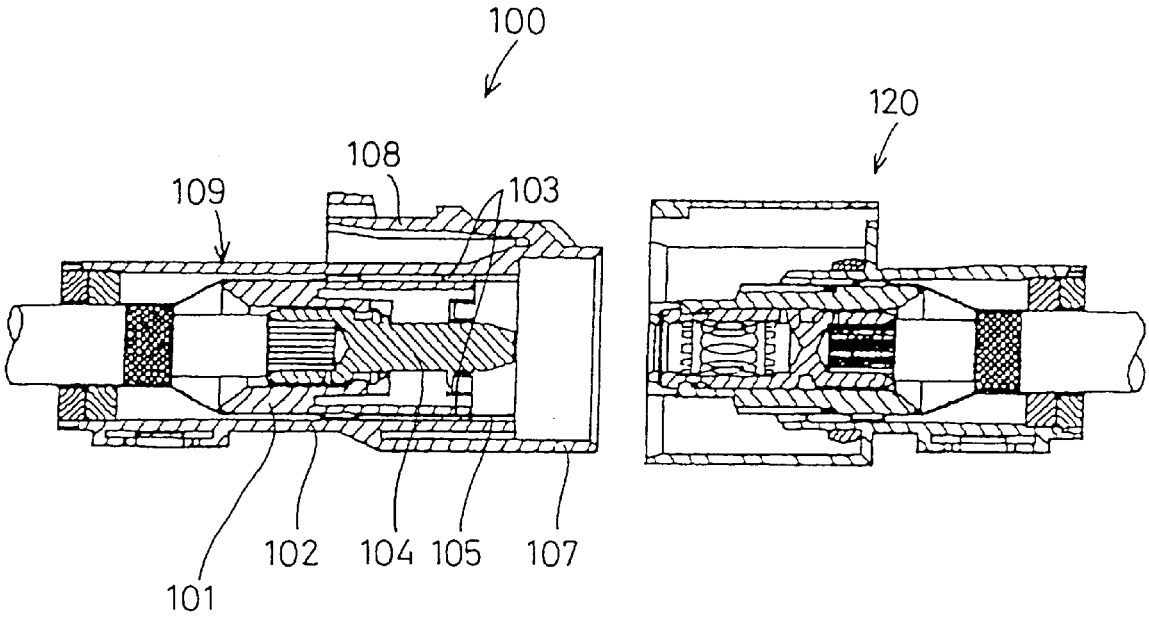
FIG. 10 is a side cross sectional view of the shielded connector according to the conventional example 1.
Figure 11:
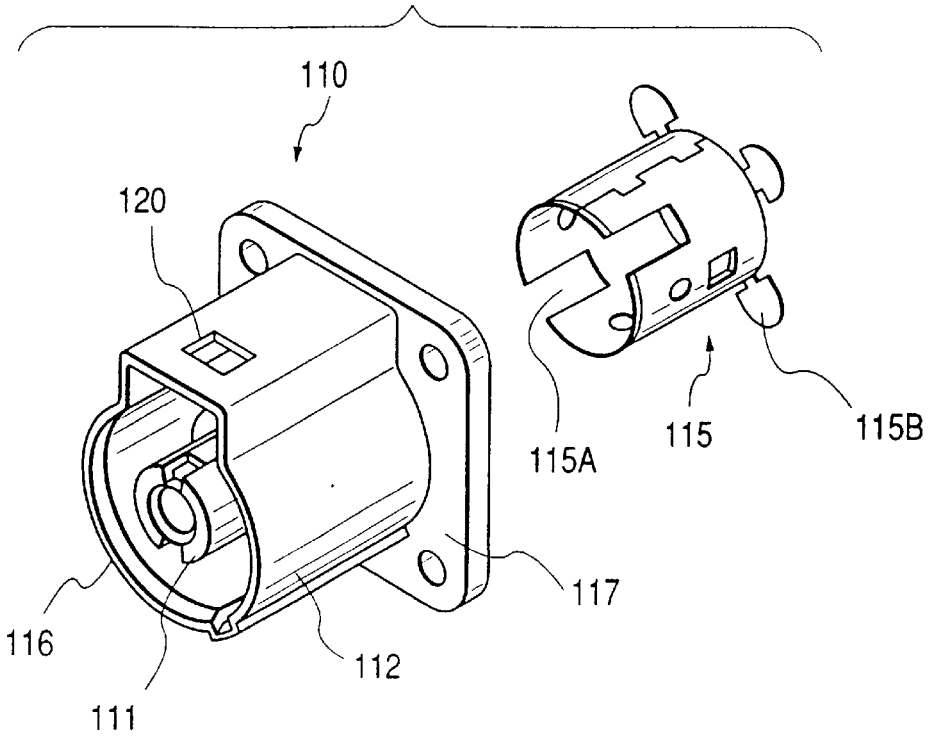
FIG. 11 (PRIOR ART)
FIG. 11 is an exploded perspective view of the shielded connector according to the conventional example 2.
Figure 12:
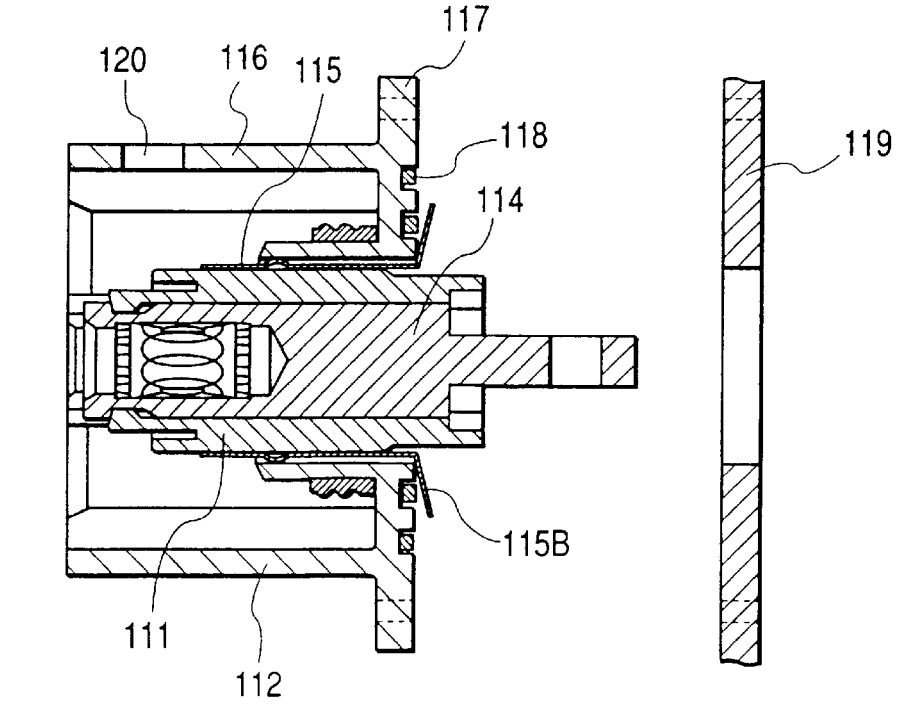
FIG. 12 (PRIOR ART)
FIG. 12 is a side cross sectional view of the shielded connector according to the conventional example 2.

Subsequently, the female connector 11 is connected with the male connector 10. Then, as shown in FIG. 8, the tab 38 of the male terminal fitting 36 is inserted into the cavity 16 of the female connector 11 and the conductively connected to both of the terminal fittings 17 and 36, and the locking arm 24 formed on the female connector 11 goes beyond and is engaged with the locking projection 58 formed on the upper surface of the male connector 10, so that both of the connectors 10 and 11 are prevented from being detached.

The contact 55 is interposed between the inner peripheral surface of the hood portion 54 of the male connector 10 and the outer peripheral surface of the shielding shell 18 of the female connector 11, and the bent portion thereof is crushed. By this action, the aluminium sleeve 31 as a shielding shell is reliably and conductively connected to the other corresponding shielding shell 18.

The passage of electric current passes through the cables D1 and D2 causes noise therearound. However, since the hood portion 54 itself serves as a shielding shell in the male connector 10 of the present embodiment, and the hood portion 54 completely enclose around the male terminal fitting 36 without any clearance, leakage of noise from the slit of the shielding shell as in the conventional connector is prevented, thereby improving the shielding property. Though a slit is formed on the other corresponding shielding shell 18, noises leaked from there may be shielded because the hood portion 54 encloses the outside of the slit.

In addition, since the aluminium flange 52 to be screwed on the shielded wall 60 is constructed of a metal, it has higher strength and heat resistant property in comparison with the conventional flange constructed of a synthetic resin. Therefore, deformation of the flange may be prevented and the conductivity between the shielded wall 60 and the aluminium sleeve 31 may be maintained in a stable manner even when the shielded cable D1 is pulled, thereby improving the reliability of the shield. Likewise, since the packing 63 is stably pressed against the shielded wall 60, high resistance to water may be established.

As is described thus far, according to the male connector 10 of this embodiment, the shielding property can be improved by enclosing around the male terminal fitting 36 by the aluminium sleeve 31 without any clearance. In addition, since it is constructed in such a manner that the aluminium flange 51 itself that fix the male connector 10 onto the shielded wall 60 is conductively connected to the shielded wall 60, the space to be used when mounting on electrical equipment may be reduced in comparison with the conventional connector wherein the portion conductively connected to the shielded wall and the flange to be used for the purpose of fixing are provided independently.

It is understood that the present invention is not limited to the embodiment described here in accordance with the description above and the attached drawings, but embodiments as shown below are also included in the technical scope of the present invention, and embodiments other than the ones shown below may be made by various changes without departing from the scope thereof.

(1) While the packing 63 of the embodiment described above is provided with a pair of stoppers 64, the stopper may be formed in such a manner that it extends all around the packing.

(2) While, in the embodiment described above, there is shown the shielded connector to be connected to the shielded wall 60 of electrical equipment to which the present invention is applied, it is also possible to apply the present invention to the shielded connector to be mounted at the terminal of the shielded cable.

(3) While, in the embodiment described above, there is shown the male connector 10 including a male terminal fitting received therein to which the present invention is applied, it is possible to apply the present invention to the female connector including a female terminal fitting received therein.

(4) While the contact 55 is provided within the aluminium sleeve 31 in the embodiment described above, it is also possible to eliminate the contact and to provide a resilient portion on the shielding shell of the other corresponding connector.

(5) While the bolt is screwed through the aluminium flange 52 in the embodiment described above, it is also possible to form a cylindrical wall extending rearward from the base portion 32 of the male housing 30 so that it can pass through the connector mounting hole 61, and cut threads on the outer peripheral portion of the cylindrical wall so that the nut can be screwed thereon.

(6) While, in the embodiment described above, there is shown an aluminium die-cast aluminium sleeve 31 as a conductive member according to the invention, metals other than aluminium (for example, iron, copper, zinc, lead, magnesium, and so on) may be use as far as it has conductivity, or a part that corresponds to the conductive member according to the invention can be formed by a conductive resin.

What is claimed is:

1. A shielded connector comprising:

a terminal fitting;

a connector housing accommodating the terminal fitting, the connector housing comprising:

a plurality of cylindrical portions for receiving terminal fittings, wherein each of the plurality of cylindrical portions creates a cavity; and an inner flange with a portion projecting outward from a base of the inner flange;

a cylindrical hood portion provided on the connector housing, the cylindrical hood portion for being fitted to a corresponding connector and having a flange extending sideward from the cylindrical hood portion, wherein the cylindrical hood portion is seamless and made of conductive material and the flange of the cylindrical hood portion having an annular groove;

locking means provided on the cylindrical hood portion for-preventing the corresponding connector from being detached from the cylindrical hood portion, wherein:

the cylindrical hood portion forms a shielding shell to shield the terminal fitting and at least a portion of each of the plurality of cylindrical portions for receiving terminal fittings is not a part of or within the cylindrical hood portion, and the inner flange of the connector housing fits with an inner wall of the annular groove of the flange of the cylindrical hood portion.

2. The shielded connector as set forth in claim 1, further comprising a shielded wall having a mounting hole, through which the connector housing penetrates, wherein the flange of the cylindrical hood portion is abutted against the shielded wall and fixed to the shielded wall so that the flange is electrically connected with the shielded wall.

3. The shielded connector as set forth in claim 2, further comprising a screw fixing the flange of the cylindrical hood portion to the shielded wall.

4. The shielded connector as set forth in claim 1, wherein the cylindrical hood portion is made of metal.

5. The shielded connector as set forth in claim 1, further comprising a contact disposed on an inner surface of the cylindrical hood portion, the contact to be resiliently in contact with a shielding shell provided on the corresponding connector, wherein the middle portion of the contact is divided into a plurality of bands projecting inwardly.

6. The shielded connector as set forth in claim 2, wherein the inner flange of the connector housing is interposed between the inner wall of the annular groove and the shielded wall.

7. The shielded connector as set forth in claim 6, further comprising a packing member disposed into the annular groove outside of the inner flange of the connector housing, the packing member is interposed between the flange of the cylindrical hood portion and the shielded wall in intimate contact manner, and wherein the packing member including a stopper projecting inwardly from the packing, the stopper is interposed between the inner flange of the connector housing and the inner wall of the annular groove.

8. A shielded connector comprising:

a connector housing for accommodating a terminal fitting, the connector housing comprising:

a plurality of cylindrical portions for receiving terminal fittings, wherein each of the plurality of cylindrical portions creates a cavity; and an inner flange with a portion projecting outward from a base of the inner flange;

a cylindrical hood portion provided on the connector housing for being fitted to the other corresponding connector and having a flange extending sideward from the cylindrical hood portion, wherein the cylindrical hood portion is seamless and the flange of the cylindrical hood portion having an annular groove;

locking means provided on the hood portion for preventing the other connector from being detached, wherein:

the hood portion is constructed by mounting a cylindrically formed conductive member to the connector housing, a shielding shell is constructed by surrounding the terminal fitting by the conductive member to shield the terminal fitting and at least a portion of each of the plurality of cylindrical portions for receiving terminal fittings is not a part of or within the cylindrical hood portion, and the inner flange of the connector housing fits with an inner wall of the annular groove.

9. The shielded connector as set forth in claim 8, wherein the cylindrical hood portion is made of metal.

10. The shielded connector as set forth in claim 8, further comprising a contact disposed on an inner surface of the cylindrical hood portion, the contact to be resiliently in contact with a shielding shell provided on the corresponding connector, wherein the middle portion of the contact is divided into a plurality of bands projecting inwardly.

11. The shielded connector as set forth in claim 8, further comprising a shielded wall having a mounting hole, through which the connector housing penetrates, wherein the flange of the cylindrical hood portion is abutted against the shielded wall and fixed to the shielded wall so that the flange is electrically connected with the shielded wall.

12. The shielded connector as set forth in claim 11, further comprising a screw fixing the flange of the cylindrical hood portion to the shielded wall.

13. The shielded connector as set forth in claim 11, wherein the inner flange of the connector housing is interposed between the inner wall of the annular groove and the shielded wall.

14. The shielded connector as set forth in claim 13, further comprising a packing member disposed into the annular groove outside of the inner flange of the connector housing, the packing member is interposed between the flange of the cylindrical hood portion and the shielded wall in intimate contact manner, and wherein the packing member including a stopper projecting inwardly from the packing, the stopper is interposed between the inner flange of the connector housing and the inner wall of the annular groove.

* * * * *

UNITED STATES PATENT AND TRADEMARK OFFICE

CERTIFICATE OF CORRECTION

PATENT NO. : 6,702,611 B1
DATED : March 9, 2004
INVENTOR(S) : Sho Miyazaki et al.

It is certified that error appears in the above-identified patent and that said Letters Patent is hereby corrected as shown below:

Title page,
Item [73], Assignee, please change "Sumitomo Wiring Systems, Inc." to
-- Sumitomo Wiring Systems, Ltd. --

Signed and Sealed this

Eighteenth Day of May, 2004

JON W. DUDAS
*Acting Director of the United States Patent and Trademark Office*